US011307006B2

(12) United States Patent
Pfaff

(10) Patent No.: US 11,307,006 B2
(45) Date of Patent: Apr. 19, 2022

(54) PROJECTILE HAVING A PYROTECHNIC EXPLOSIVE CHARGE

(71) Applicant: RWM SCHWEIZ AG, Zürich (CH)

(72) Inventor: Andreas Pfaff, Zürich (CH)

(73) Assignee: RWM Schweiz AG, Zürich (CH)

( * ) Notice: Subject to any disclaimer, the term of this patent is extended or adjusted under 35 U.S.C. 154(b) by 0 days.

(21) Appl. No.: 16/975,470

(22) PCT Filed: Feb. 22, 2019

(86) PCT No.: PCT/EP2019/054464

§ 371 (c)(1),
(2) Date: Aug. 25, 2020

(87) PCT Pub. No.: WO2019/162451

PCT Pub. Date: Aug. 29, 2019

(65) Prior Publication Data

US 2021/0018305 A1 Jan. 21, 2021

(30) Foreign Application Priority Data

Feb. 26, 2018 (DE) ..... 10 2018 104 333.3

(51) Int. Cl.
*F42B 12/36* (2006.01)
*F42B 12/06* (2006.01)
*F42B 12/44* (2006.01)

(52) U.S. Cl.
CPC ..... *F42B 12/367* (2013.01); *F42B 12/06* (2013.01); *F42B 12/44* (2013.01)

(58) Field of Classification Search
CPC ..... F42B 12/367; F42B 12/06; F42B 12/44
USPC ..... 102/517
See application file for complete search history.

(56) References Cited

U.S. PATENT DOCUMENTS 2,115,047 A * 4/1938 Stevenson ..... C06B 33/02 149/108.4
3,302,570 A 2/1967 Marquardt
4,237,787 A * 12/1980 Wacula ..... C06B 33/02 102/306

(Continued)

FOREIGN PATENT DOCUMENTS

DE 12 78 290 9/1968
DE 3240310 A1 6/1983

(Continued)

OTHER PUBLICATIONS

International Search Report from corresponding PCT Application No. PCT/EP2019/054464, dated May 21, 2019.

*Primary Examiner* — Samir Abdosh
(74) *Attorney, Agent, or Firm* — Harness, Dickey & Pierce, P.L.C.

(57) ABSTRACT

The invention relates to a projectile (1, 8, 9) having at least one payload (5) or explosive charge in the projectile body (2, 7, 10), preferably in the medium caliber range, the payload (5) being integrated into the projectile body (2, 7, 10) in the form of a pyrotechnic charge. The payload (5) can preferably be enclosed and sealed by a core (6, 14) which preferably consists of metal or plastic. In an alternative embodiment, the pyrotechnic payload (5) is disposed behind a penetrator (11) in the projectile body (10), the payload (5) thus being located between the penetrator (11) and the projectile body (10).

9 Claims, 3 Drawing Sheets

(56) References Cited

U.S. PATENT DOCUMENTS

| | | | | |
|---|---|---|---|---|
| 4,438,700 | A * | 3/1984 | Knapp | C06B 33/12 149/40 |
| 5,347,907 | A | 9/1994 | Strandli et al. | |
| 5,652,408 | A * | 7/1997 | Nicolas | F42B 12/208 102/491 |
| 5,728,968 | A * | 3/1998 | Buzzett | F42B 14/061 102/703 |
| 7,603,951 | B2 * | 10/2009 | Rose | F42C 1/10 102/500 |
| 8,075,715 | B2 * | 12/2011 | Ashcroft | C06B 45/00 149/43 |
| 8,122,833 | B2 * | 2/2012 | Nielson | F42B 12/36 102/516 |
| 8,568,541 | B2 * | 10/2013 | Nielson | F42B 12/44 149/37 |
| 8,635,957 | B2 * | 1/2014 | Orlev | F42B 12/46 89/1.13 |
| 9,103,641 | B2 * | 8/2015 | Nielson | F42B 12/74 |
| 9,982,981 | B2 * | 5/2018 | Nielson | C06B 45/12 |
| 2003/0205160 | A1 | 11/2003 | Oechslin et al. | |
| 2006/0011086 | A1 | 1/2006 | Rose et al. | |
| 2011/0168047 | A1 * | 7/2011 | Hah | F41J 2/02 102/347 |
| 2012/0186479 | A1 * | 7/2012 | Skidmore | F42B 33/06 102/364 |

FOREIGN PATENT DOCUMENTS

| | | | |
|---|---|---|---|
| DE | 692 13 612 | T2 | 1/1997 |
| DE | 10 2006 025 330 | A1 | 12/2007 |
| DE | 10 2012 023 700 | A1 | 6/2014 |
| DE | 10 2013 002 119 | A1 | 8/2014 |
| DE | 10 2005 039 901 | B4 | 2/2015 |
| EP | 0238818 | A1 | 9/1987 |
| EP | 0 531 697 | B1 | 6/1997 |
| EP | 1 316 774 | B1 | 5/2006 |
| EP | 1 000 311 | B1 | 7/2006 |
| GB | 2474824 | A | 5/2011 |
| JP | 2004-501339 | A | 1/2004 |
| JP | 2011-047527 | A | 3/2011 |
| RU | 2 082 943 | C1 | 6/1997 |
| RU | 2 407 980 | C2 | 12/2010 |

* cited by examiner

PROJECTILE HAVING A PYROTECHNIC EXPLOSIVE CHARGE

CROSS REFERENCE TO RELATED APPLICATIONS

This application is a national phase entry of PCT/EP2019/054464, filed on 22 Feb. 2019, which claims priority to and the benefit of German Patent Application No. 10 2018 104 333.3, filed on 26 Feb. 2018, the entire contents of which are incorporated herein by references.

FIELD

The invention relates to a pyrotechnic charge or payload in a projectile, in particular in the medium caliber range.

BACKGROUND

Types of ammunition known in the art frequently no longer have a penetrating effect on modern armoring systems. New types of ammunition, such as PELE® ammunition, are also designed to achieve a great fragmentation effect after the target object has been penetrated.

EP 1 316 774 B1, EP 1 000 311 B1 describe the so-called PELE effect which is used in so-called PELE-T or PELE-T Pen projectiles. Furthermore, HE ammunition is known in the art which achieves fragmentation acceleration via a detonative reaction of secondary explosives.

Lateral acceleration through the PELE effect is substantially predefined by the target velocity. The greater the firing distance the weaker the effect. The fragmentation cone becomes smaller as a result. This represents in practice a weakening of the projectile's effectiveness in the target.

The fragmentation acceleration when using HE (high explosive) projectiles or ammunition such as explosive grenades is widely known to be very good. However, explosives are used which increase the safety risk of a projectile of this kind over the entire life cycle. In addition, separate fuse components are required.

Multipurpose (MP) ammunition displays the same problems as HE ammunition, even though no conventional fuse chains are used in this case. However, the problem emerges of undefined states such as unexploded projectiles or reactions in the weapon during delivery problems.

HE and MP projectiles generally contain secondary explosives which are initiated by a pyrotechnic composition (MP) or a separate detonator (HE).

EP 0 531 697 B1 discloses a multipurpose projectile which comprises a casing, a penetrator, and at least one incendiary charge. The incendiary charge in this case is pressed in over its entire cross section.

A projectile with an outer and/or central penetrator is known from DE 10 2005 039 901 B4. Both the external penetrator and the central penetrator may be formed by sub-projectiles. Although this type of projectile is in step with actual practice, the effectiveness or performance in the target depends on the impact velocity in this case too.

The problem that arises here is that of disclosing a projectile which overcomes the aforementioned disadvantages.

The problem is solved by the features of patent claim 1. Advantageous embodiments are contained in the subclaims.

The idea underlying the invention is that of disclosing a projectile which achieves a significant increase in the lateral fragmentation effect by comparison with a PELE projectile without the need for an explosive or fuse. The aim is to combine a pyrotechnic charge with the tried-and-tested PELE effect in a medium caliber projectile, in particular.

Explosive-free projectiles are known from DE 10 2012 023 700 A1 and DE 10 2013 002 119 A1. The explosive-free projectile according to DE 10 2012 023 700 A1 releases a fuel or a fuel mixture when it disintegrates in the target. A spontaneous reaction of this mixture is brought about by at least one explosive-free, spark-generating detonation mechanism actuated during the impact fragmentation. These explosive-free projectiles are used to create an optical and thermal target signature.

SUMMARY

The implementation of the present idea involves incorporating a non-detonatable pyrotechnic composition as the payload. A metal powder/oxidizing agent is preferably provided as the pyrotechnic composition. Upon impact at the target, the shock wave has a fragmenting effect and simultaneously initiates the payload, so that the expanding gases of the pyrotechnics accelerate the casing fragments of the projectile body surrounding them laterally in addition laterally and independently of the firing distance and therefore of the impact velocity. Use is made in this case of the redox reaction, during which the chemical reaction of the pyrotechnic composition brings about a sudden exothermic redox reaction when the gas is released, expands greatly in a temperature-induced manner, and therefore causes the explosive force.

The use of the redox system, or redox systems, means that a certain secondary blast effect can be achieved. The pyrotechnic payload may, in addition, produce a flash-bang effect at the target or improve the perception acoustically. Apart from marking the point of impact, the enemy can thereby be suppressed.

The multipurpose projectile created in this way fulfils the role of armoring performance, i.e. the projectile can pierce armoring, form fragments and also create pyrotechnic effects in the target, such as incendiary, blast, flash and/or bang effects.

The advantage of this solution is that both secondary explosives and a fuse, or fuse chains, can be dispensed with. Because the pyrotechnic payload is initiated even at low impact velocities, the problem of unexploded projectiles is small. In fact, the use of a pyrotechnic payload means that no conventional unexploded projectiles actually occur.

In a first embodiment, the pyrotechnic payload is introduced in a projectile body of the projectile. It may be positionally fixed by a plate, an epoxy resin, or the like. Alternatively, the pyrotechnic payload may be introduced into a projectile tip of the projectile.

A second embodiment results when a core is introduced into the projectile. This can then fix the pyrotechnic payload positionally. The material of the core may exhibit a lower density than the projectile body, although this is not a condition. A metal or plastic can be used as a preferred embodiment.

In a third, preferred embodiment, the pyrotechnic payload may be located between a projectile body and a penetrator. The payload may be enclosed and sealed by a core which is preferably made of a metal or a plastic.

As a development of this idea, the pyrotechnic payload is disposed in a ring-shaped manner about the penetrator. The projectile body enclosing the pyrotechnic payload creates the desired fragments following initiation of the payload.

The proposal is therefore for a projectile having a new payload or charge in a projectile body, preferably in the medium caliber range. Upon impact of the projectile, a shockwave is produced which leads to the formation of splinters or fragments of the projectile body at least. At the same time, initiation of the pyrotechnic payload takes place due to the shockwave that has been initiated, so that the pyrotechnic payload reacts and the expanding gases of the pyrotechnic payload further accelerate the casing fragments of the projectile body surrounding them. There is no detonative reaction of the payload during this, which means that it belongs to a different substance class to conventional explosives. This makes the disposal of ammunition less costly. In addition, the handling safety of ammunition of this kind is improved. The lateral effect is increased by comparison with pure PELE projectiles. Moreover, a secondary composition is dispensed with. The lateral effect of the PELE ammunition is increased and leads to a less sharp decline in the case of long firing distances.

BRIEF DESCRIPTION OF THE DRAWINGS

The invention is to be explained in greater detail with the help of an exemplary embodiment with drawing. In the drawing.

DETAILED DESCRIPTION

Figure 1:
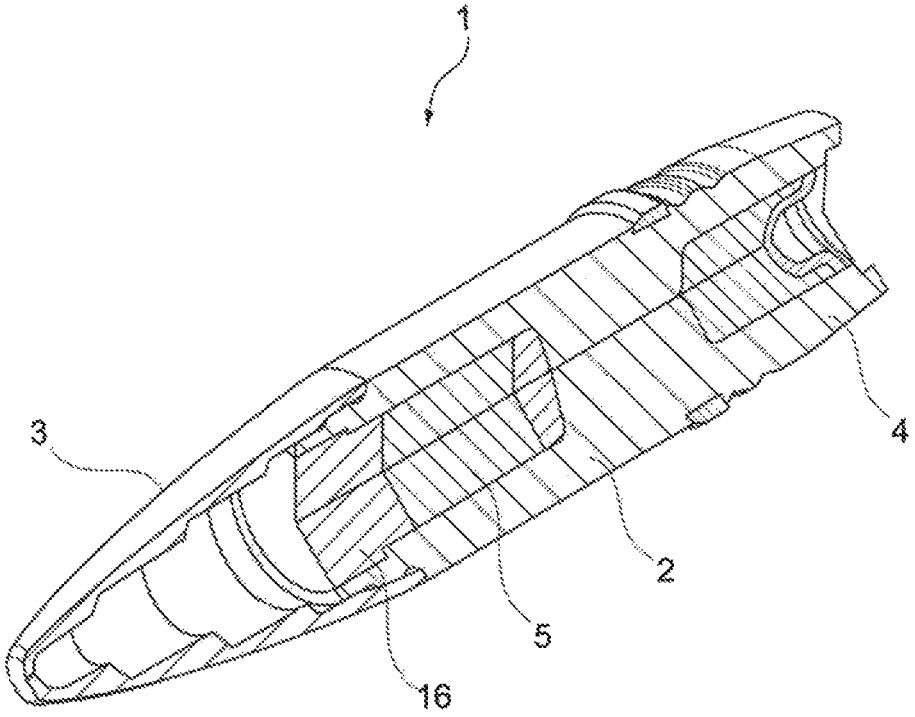
FIG. 1 shows a first variant of a projectile according to the invention.

In an embodiment depicted in FIG. 1, a projectile 1 comprises a projectile body 2 which comprises a projectile tip 3, also referred to as an ogive or cap, at the front end, and a projectile tail 4 at the rear end. A pyrotechnic payload 5 is introduced in the projectile body 2. This may be positionally fixed by a plate, an epoxy resin 16, or the like. Alternatively, the pyrotechnic payload 5 may be incorporated in the projectile tip 3.

Figure 2:
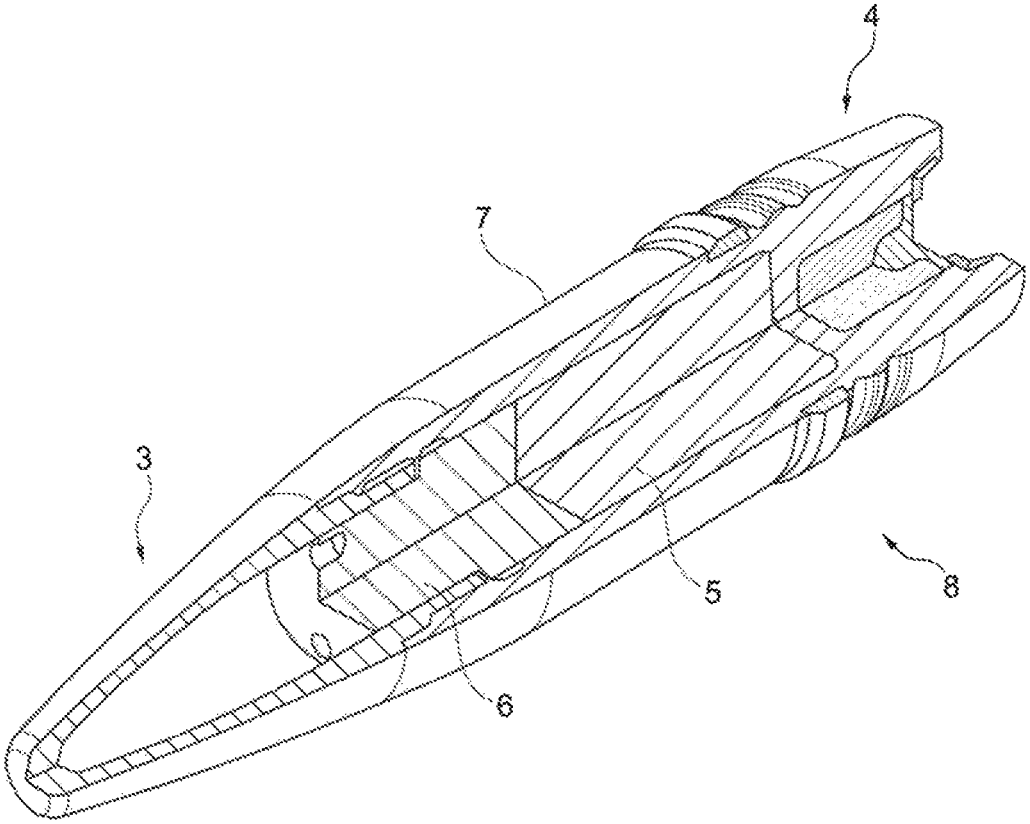
FIG. 2 shows a further variant of the projectile.

An alternative is shown in FIG. 2. The pyrotechnic payload 5 is incorporated between the core 6 and a projectile body 7 of a projectile 8. The core 6 is preferably made of a metal or a plastic.

Figure 3:
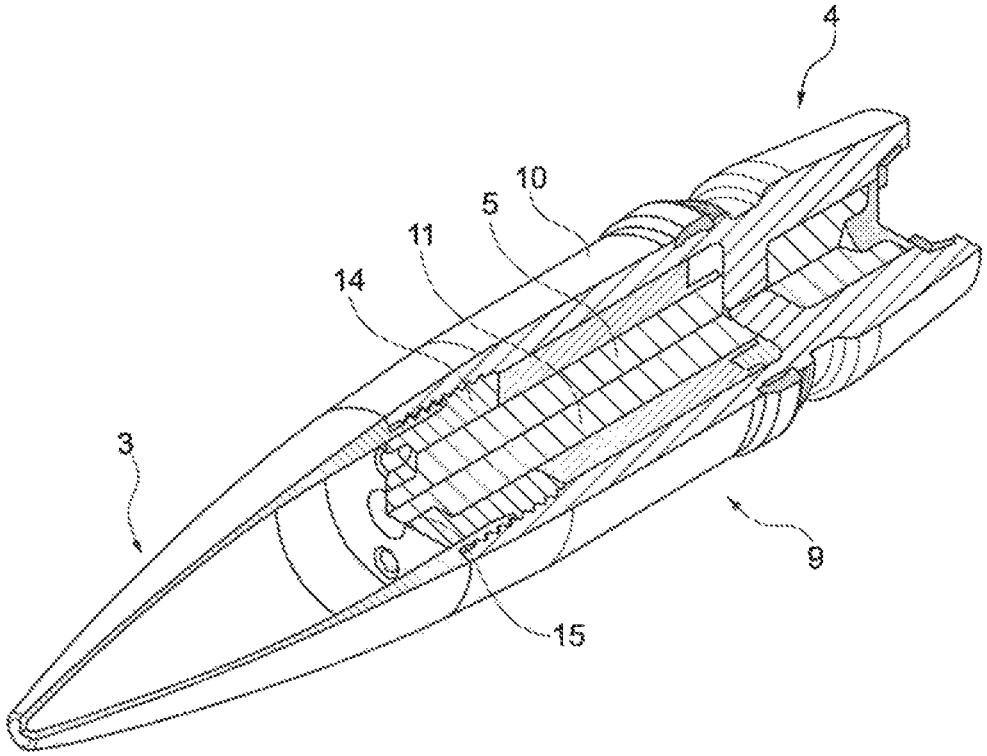
FIG. 3 shows a third variant of the projectile.

FIG. 3 shows a projectile 9 having a projectile body 10 and a penetrator 11. The projectile body 10 in this case also has a projectile tip 3 at the front end and a projectile tail 4 at the rear end. The penetrator 11 may, for its part, be breakable. The pyrotechnic payload 5 is incorporated between the projectile body 10 and the penetrator 11. In the preferred embodiment, the pyrotechnic payload 5 is preferably disposed in a ring-shaped manner about the penetrator 11. The payload 5 in this case may cover the penetrator 11 completely, but at least partially. The payload 5 is enclosed by a core 14 and thereby sealed. The core 14 in this case sits on the penetrator 11 at least partially. The core 14 preferably has a bore 15 into which the penetrator 11 can project. This bore 15 is preferably adapted to the outer geometry of the penetrator 11. The core 14 itself is preferably made of a metal or a plastic. The penetrator 11 can be positionally fixed in the projectile 9, or in the projectile body 10, by the core 14. Alternative mountings for fixing the penetrator 11 are likewise possible.

Projectile bodies 2, 7, 10 and projectile tips 4 may be connected to one another via a screw connection. Alternative connections, such as a snap-fit connection, for example, are likewise possible.

The method of operation is as follows:

The known PELE effect is triggered by the impact of the projectile 1, 8, 9 in the target, e.g. a metal plate. At the same time, a shockwave is initiated in the projectile body 2, 7, 10 and, if present, also in the core 6 (FIG. 2) or in the core 14 and the penetrator 14 (FIG. 3).

The shockwave acts, on the one hand, on the casing of the projectile body 2, 7, 10 in a fragmenting manner (not depicted in greater detail). Furthermore, the pyrotechnic composition 5, or the pyrotechnic payload 5, is simultaneously initiated by adiabatic compression due to this shockwave. In this way, the reaction temperature, or the reaction threshold, of the redox system, i.e. of the payload 5 (pyrotechnics), is exceeded. The payload 5 reacts immediately. The expanding gases of the pyrotechnic payload 5, for their part, further accelerate laterally the casing fragments of the projectile body 2, 7, 10 surrounding the payload 5 and being formed by the shockwave upon impact.

The payload 5 may comprise multiple pyrotechnic compositions which generate an incendiary effect, a flash and/or bang effect at the target.

It is advantageous for the fragmentation cone which forms (opening angle of the cone) of the casing fragments of the projectile body 2, 7, 10 to be constant, since this is independent of the firing distance (of the impact velocity).

The projectile body 2, 7, 10 may, in addition, be provided with predetermined breaking points on the circumference (not depicted in greater detail). These may then support the fragmentation of the projectile 1, 8, 9. The predetermined breaking points may also mean that the casing fragments of the projectile body 2, 7, 10 are better defined in terms of size.

What is claimed is:

1. A projectile having at least one projectile body, a core, and a payload, wherein the payload is at least a pyrotechnic composition, wherein the core encloses and seals the pyrotechnic payload, and wherein the pyrotechnic payload is configured to initiate in response to a shockwave formed upon impact of the projectile at a target, independent of a separate pyrotechnic composition.

2. The projectile as claimed in claim 1, wherein the pyrotechnic payload is non-detonatable.

3. The projectile as claimed in claim 1, wherein the core is a metal or a plastic.

4. The projectile as claimed in claim 3, wherein the pyrotechnic payload is introduced between the projectile body and a penetrator.

5. The projectile as claimed in claim 4, wherein the pyrotechnic payload is disposed partially or completely about the penetrator.

6. The projectile as claimed in claim 5, wherein the pyrotechnic payload is disposed in a ring-shaped manner about the penetrator.

7. The projectile as claimed in claim 1, wherein the pyrotechnic payload is a material for producing a fire, fog, flash and/or bang effect.

8. The projectile as claimed in claim 1, wherein the projectile body has predetermined breaking points on the circumference.

9. A method of target engagement using a projectile according to claim 1, the method comprising:

producing the shockwave upon impact of the projectile for the formation of splinters or fragments of the projectile body at least, and initiating the pyrotechnic payload by the initiated shockwave, so that the pyrotechnic payload reacts, wherein the expanded gases of the pyrotechnic payload further accelerate the casing fragments of the projectile body surrounding them.

* * * * *